US010290943B2

(12) United States Patent
Shehan

(10) Patent No.: US 10,290,943 B2
(45) Date of Patent: May 14, 2019

(54) SLEEVE MONOPOLE ANTENNA WITH SPATIALLY VARIABLE DIELECTRIC LOADING

(71) Applicant: Amphenol Antenna Solutions Inc., Rockford, IL (US)

(72) Inventor: Joshua W. Shehan, Hudson, NC (US)

(73) Assignee: Amphenol Antenna Solutions, Inc., Rockford, IL (US)

( * ) Notice: Subject to any disclaimer, the term of this patent is extended or adjusted under 35 U.S.C. 154(b) by 108 days.

(21) Appl. No.: 15/350,984

(22) Filed: Nov. 14, 2016

(65) Prior Publication Data

US 2018/0138599 A1 May 17, 2018

(51) Int. Cl.

| | |
|---|---|
| ***H01Q 5/50*** | (2015.01) |
| ***H01Q 9/22*** | (2006.01) |
| ***H01Q 9/30*** | (2006.01) |
| ***H01Q 9/32*** | (2006.01) |
| ***H01Q 13/06*** | (2006.01) |

(52) U.S. Cl.
CPC ..... *H01Q 9/32* (2013.01); *H01Q 5/50* (2015.01); *H01Q 9/30* (2013.01); *H01Q 13/06* (2013.01); *H01Q 9/22* (2013.01)

(58) Field of Classification Search
CPC ..... H01Q 15/10; H01Q 13/28
USPC ..... 343/790, 791
See application file for complete search history.

(56) References Cited

U.S. PATENT DOCUMENTS 3,886,558 A 5/1975 Cary et al.
6,377,226 B1 * 4/2002 Ha ..... H01Q 1/242 343/791
6,963,313 B2 * 11/2005 Du ..... H01Q 1/22 343/790
8,063,848 B2 11/2011 Perkins, III
2009/0131926 A1 * 5/2009 Rusin ..... A61B 18/18 606/33
2010/0238088 A1 * 9/2010 Mukai ..... H01Q 9/16 343/859

(Continued)

FOREIGN PATENT DOCUMENTS

EP 2281522 A1 2/2011
GB 2316539 A 2/1998

(Continued)

OTHER PUBLICATIONS

Z. H. Hu, et al., "Wideband Conical Monopole Antenna with Integrated Stopband Filter", Progress in Electromagnetics Research C, vol. 27, pp. 223-238, 2012.

(Continued)

*Primary Examiner* — Ricardo I Magallanes
(74) *Attorney, Agent, or Firm* — Blank Rome LLP

(57) ABSTRACT

A dielectric loaded sleeve monopole antenna has a dielectric loading within the sleeve enables stable impedance in a dynamic operating environment. The use of a dielectric filling in the sleeve portion of the antenna enables tight control of the input impedance over frequency establishing stable broadband operation in challenging operating environments. The effective dielectric constant inside the sleeve of the antenna is designed to exhibit spatial variability. As a result, the sleeve essentially acts as an impedance transformer enhancing control over the input impedance to the antenna. The spatial variability in the dielectric filling may be realized as arrangements of single or multiple dielectric materials machined to synthesize the desired effective dielectric properties.

16 Claims, 9 Drawing Sheets

(56) References Cited

U.S. PATENT DOCUMENTS

| | | | | |
|---|---|---|---|---|
| 2011/0063185 | A1 | 3/2011 | Lin et al. | |
| 2012/0293279 | A1 | 11/2012 | Gong et al. | |
| 2013/0165915 | A1* | 6/2013 | Thiel | A61B 90/57 606/33 |

FOREIGN PATENT DOCUMENTS

| | | | |
|---|---|---|---|
| JP | 5779706 | | 5/1982 |
| JP | 9331207 | A | 12/1997 |
| WO | WO-2016/054156 | A1 | 4/2016 |

OTHER PUBLICATIONS

R. W. Ziolkowski, Design, Fabrication, and Testing of Double Negative Metamaterials, IEEE Transactions on Antennas and Propagation, vol. 51, No. 7, Jul. 2003, pp. 1516-1529.

Y. S. Li, et al., "A Sleeve Monopole Antenna with Wide Impedance Bandwidth for Indoor Base Station Applications", Progress in Electromagnetics Research C., vol. 16, 2010, pp. 223-232.

P. Huang, et al., "Design of a Wideband Sleeve Antenna with Symmetrical Ridges", Progress in Electromagnetics Research Letters, vol. 55, 2015, pp. 137-143.

Y. Li, et al., "A Novel Wideband Sleeve Antenna with Capacitive Annulus for Wireless Communication Applications", Progress in Electromagnetics Research C., vol. 52, 2014, pp. 1-6.

A. Petosa, et al., "Design and Performance of a Perforated Dielectric Fresnel Lens", IEEE Proceedings: Microwaves, Antennas and Propagate; vol. 150, No. 5, Aug. 29, 2003; pp. 309-314.

M. Moeini-Fard et al., "Inhomogeneous Perforated Reflect-Array Antennas", Wireless Engineering and Technology, vol. 2, No. 2, Apr. 30, 2011, pp. 80-86.

European Search Report for EP Application No. 17197497.5, dated Mar. 13, 2018, 10 pages.

* cited by examiner

SLEEVE MONOPOLE ANTENNA WITH SPATIALLY VARIABLE DIELECTRIC LOADING

BACKGROUND OF THE INVENTION

Field of the Invention

The present invention generally relates to antennas, and more specifically to the sleeve monopole antenna with dielectric loading.

Background of the Related Art

Distributed antenna systems (DAS) include a plurality of antennas distributed throughout a particular coverage area. DAS solutions are generally deployed to provide wireless coverage in areas that cannot be covered by a single access point. This is generally due to structures in the coverage area that would impede the wireless signal generated by the antenna at the access point from reaching all users within the coverage area. Some examples include office buildings, university campuses, and stadiums.

An antenna is generally impacted by objects in close proximity to the antenna especially when the object falls within the antenna's near field. Nearby objects can cause difficulties in impedance matching making it necessary to consider the operating environment in the antenna design. This can be challenging for DAS networks where the antenna mounting locations are compromised due to physical space limitations or city and government regulations. The resulting mounting locations can place antennas in close proximity to support structures or other infrastructure that can make it difficult to achieve satisfactory antenna performance. These mounting locations can also force the antennas into positions where people may pass through the nearfield of the antenna. The human body is largely composed of water and exhibits a high dielectric constant. As a result, people moving through the nearfield of an antenna can have an impact on the input impedance to the antenna. Furthermore, antenna size can be limited where the antenna is constrained to fit within a given volume, and limitations in the ability to impedance match the antenna may result. The effect of objects within the nearfield of an antenna is further compounded for omnidirectional antennas that are affected by obstructions in multiple directions. Outdoor DAS networks may present additional challenges where inclement weather can create dynamic operating environments. For example, antennas mounted near concrete structures may need to consider the loading effects of the concrete. This becomes a challenge when the concrete is exposed to water, i.e. rain or snow, as the concrete absorbs water due to its porosity. As a result, the dielectric properties of the concrete can be impacted which can, in turn, impact the loading effects on a nearby antenna. Broadband DAS networks are also challenging due to the need to maintain antenna performance over a broad frequency range. Lower frequencies have longer wavelengths than higher frequencies, and as a result, the electrical distance of an object to an antenna varies with frequency. Objects that may not have a significant impact to the antenna at higher frequencies may become problematic at lower frequencies.

As an example, U.S. Patent App. No. 62/347,801 discloses a thin, dual band stadium DAS antenna where the antenna is mounted on stadium railing near the concrete of the stadium steps. The '801 application is hereby incorporated by reference. As a result of the mounting location and size limitations, the low band antennas in the '801 application suffer from the difficulties in impedance matching and warrant a broadband impedance matching solution.

Antennas currently are metallic loaded, as shown for instance in "A Sleeve Monopole Antenna with Wide Impedance Bandwidth for Indoor Base Station Applications," to Y. S. Li et al., Progress in Electromagnetics Research C., Vol. 16, pp. 223-232, 2010, "Design of a wideband sleeve antenna with symmetrical ridges," Peng Huang et al., Progress in Electromagnetics Research letters, Vol. 55, pp. 137-143, 2015, and "A novel wideband sleeve antenna with capacitive annulus for wireless communication applications," Progress in Electromagnetics Research C, Vol. 52, pp. 1-6, 2014. Those antennas are costly to fabricate and complicated to assemble.

An improvement in DAS antennas is desired whereby the antenna can maintain sufficient performance over a broad frequency range in challenging operational environments.

SUMMARY OF THE INVENTION

The present invention details a sleeve monopole antenna with spatially variable dielectric loading and a limited size ground plane to address the aforementioned difficulties in distributed antennas systems. The antenna generally consists of a sleeve approximately $\lambda/4$ in length extending distally from a ground plane where the sleeve and ground plane are in electrical contact. The ground plane is limited to approximately $\lambda/6$ in diameter corresponding to the '801 application and extends in the opposite direction of the sleeve approximately $\lambda/12$ in length. The sleeve surrounds a primary radiating element that also extends distally from a ground plane generally $\lambda/4$ beyond the end of the sleeve. The size and shape of the primary radiating element, sleeve, and ground along with the characteristics of the material filling the area between the sleeve and primary radiating element make the sleeve monopole a robust antenna element with the ability to achieve a good impedance match in challenging operating environments. When the input impedance matches the impedance of the network feeding the antenna, less energy is reflected from the antenna input and more energy is allowed radiated from the antenna. As a result, the system becomes more efficient, and less power is required by the transmitter to achieve a desired power level at the receiver. Furthermore, the radiation characteristics of the antenna make it well suited for DAS networks where omnidirectional radiation is desired.

The sleeve monopole antenna inherently provides some immunity to its operational environment due to the sleeve shielding the feed point of the antenna. A dielectric material between the sleeve and the primary radiating element provides an additional tuning parameter so the antenna has the ability to maintain an acceptable impedance match in challenging operational environments. Furthermore, spatial variations in the effective dielectric constant between the sleeve and the main radiator offers enhanced control of the input impedance to the antenna over approaches where a dielectric filler may be homogeneous or nonexistent. The spatial variation of the material allows the sleeve to function similar to a broadband impedance transformer enabling acceptable impedance matching over frequency. Synthesis techniques to realize the effective dielectric constant(s) are also disclosed.

These and other objects of the invention, as well as many of the intended advantages thereof, will become more readily apparent when reference is made to the following description, taken in conjunction with the accompanying drawings.

DETAILED DESCRIPTION OF THE PREFERRED EMBODIMENTS

Figure 1A:
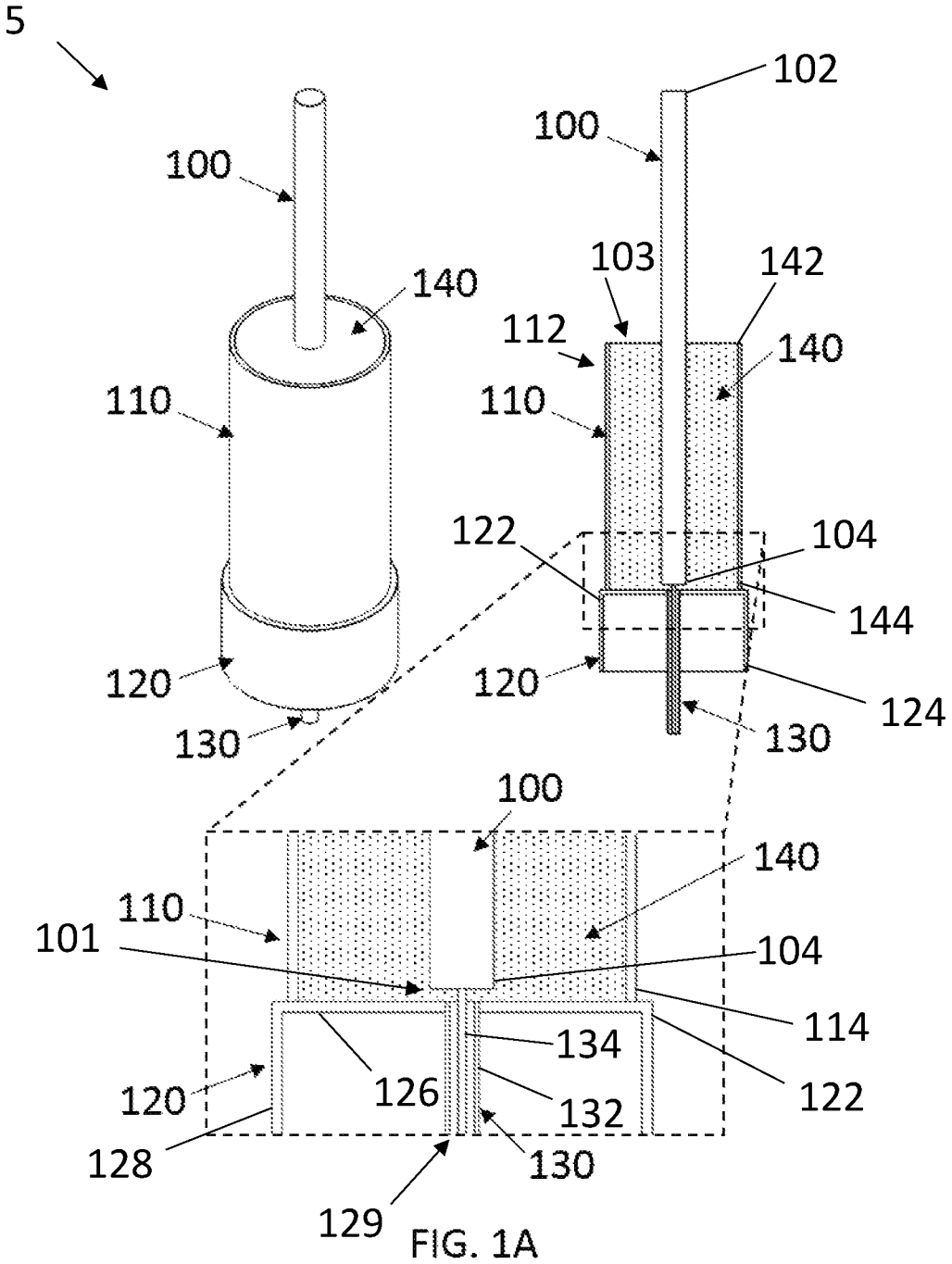
FIGS. 1A-1B illustrate the basic construction of the sleeve monopole with spatially variable dielectric loading.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents that operate in similar manner to accomplish a similar purpose. Several preferred embodiments of the invention are described for illustrative purposes; it being understood that the invention may be embodied in other forms not specifically shown in the drawings.

The present invention details a dielectric loaded sleeve monopole exhibiting broadband operation in challenging operational environments. The sleeve monopole is an uncomplicated yet robust antenna that can be configured to operate over broad bandwidths. For purposes of the present invention, an antenna exhibiting a −10 dB return loss over a 25% or greater fractional bandwidth is considered to be broadband. The antenna in the preferred embodiment is omnidirectional in nature and designed to operate, for example, over the cellular frequency bands from 696-960 MHz (~33% fractional bandwidth). The antenna is suited for DAS antenna systems where the antenna is designed to operate with omnidirectional radiation characteristics. However, as those skilled in the art can appreciate, the radiation pattern for the antenna in its operating environment will likely differ from the free-space radiation pattern depending on the operating environment and the objects in close proximity to the antenna. From an impedance matching perspective, the antenna is well-suited for operation in challenging environments where impedance matching techniques beyond those of the traditional sleeve monopole antenna are required.

The sleeve monopole inherently exhibits some immunity to its operating environment due to the feed point of the antenna being shielded by the sleeve. Dielectric loading within the sleeve of the antenna adds a degree of freedom in tuning the antenna and enhances the designer's ability to control the input impedance. Furthermore, spatial variation in the dielectric loading material opens yet another degree of freedom over traditional approaches improving control over the input impedance to the antenna. Any suitable machined dielectrics can be utilized, which is a simple, low cost approach and improves on metallic loading.

With respect to FIG. 1A, the general structure of the dielectric loaded sleeve monopole antenna 5 is illustrated in accordance with a non-limiting example embodiment of the invention. As shown, the antenna 5 includes a primary radiating element or radiator 100, a sleeve 110, and an RF ground structure 120. The antenna further includes a dielectric loading 140 between the sleeve 110 and the primary radiator 100 along with a coaxial feed cable 130 to supply RF signal to the antenna.

The primary radiator 100 can be, for example, a solid elongated rod having a generally cylindrical shape with a circular cross-section. The radiator 100 is conductive and made of metal. The radiator 100 has a proximal end 102 and a distal end 104 opposite the proximal end 102.

The sleeve 110 is a hollow tube composed of a material with substantially high conductivity. Copper is the material of choice in the preferred embodiment, for example, due to the ability to solder to copper. The sleeve 110 surrounds the entire dielectric loading 140 along with the distal end 104 of the primary radiator 100. The sleeve 110 is elongated and in the shape of a cylinder, and has a proximal end 112 and a distal end 114. The proximal end 112 and the distal end 114 are both open. The radiator 100 is at least partly received in the sleeve 110. As shown, the distal portion (for example, approximately the entire distal half) of the radiator 100 including the distal end 104, is received in the sleeve 110. The distal end 104 of the radiator 100 is nearly fully received into the sleeve 110, so that the distal end 104 of the radiator 100 is nearly flush with the distal end 114 of the sleeve 110. There is a small gap or distance between the distal end 104 of the radiator 100 and the distal end 114 of the sleeve 110, so that the distal end 104 of the radiator is slightly recessed from the distal end 114 of the sleeve 110. As further illustrated, the radiator 100 is substantially centrally located within the sleeve 110 so that the radiator 100 is concentric with the sleeve 110.

In one example embodiment, the RF ground 120 is in the shape of a cap that is a circular cylinder. The ground structure 120 has a circular side 128, a proximal end 122 that is closed and a distal end 124 that can be opened or closed. The closed proximal end 122 forms a flat top surface 126 that provides a small RF ground plane for the primary radiator 100. Like the sleeve 110, the RF ground 120 is also composed of copper in a preferred example embodiment. The top surface 126 of the RF ground 120 is also in direct contact with the distal end 114 of the sleeve 110 such that the two are electrically shorted. The side 128 of the RF ground 120 extends away from the flat top surface 126 in the opposite direction from the sleeve 110 and primary radiator 100. The radiator 100 can extend substantially orthogonally from the ground structure 120. That is, the longitudinal axis of the radiator 100 can be substantially orthogonal to the center axis of the ground structure 120. The radiator 100 is orthogonal to the portion of the RF ground where the cable attaches, as shown in FIGS. 1, 3-6. As further shown, there is a small space or gap 101 between the distal end 104 of the radiator 100 and the top surface 126 of the ground structure 120, so that the radiator 100 does not come into contact with the ground structure 120.

An opening or hole 129 extends through the RF ground structure 120, and for example can extend centrally through the middle of the ground structure 120. In an alternative embodiment, the ground structure 120 can be hollow, and the hole 129 can extend only through the top 126 of the ground structure 120. The coaxial feed cable 130 extends through the entire ground structure 120 via the hole 129. Thus, the cable 130 extends from outside of the ground structure 120 into the ground structure 120 at the distal end 124, through the hole 129, and exits out of the proximal end 122 of the ground structure 120. In this way, the cable 130 provides an RF signal to the antenna 5.

The cable 130 has an outer jacket 132 and a center conductor 134. The outer jacket 132 of the coaxial feed cable 130 is in electrical contact with the RF ground 120 and the center conductor 134 of the coaxial feed cable 130 is in electrical contact with the primary radiator 100. The outer jacket 132 is metal and there is insulation between the outer jacket 132 and the conductor 134 (e.g., Teflon (PTFE)). In the example embodiment shown, the outer jacket 132 of the coaxial feed cable 130 is soldered directly to RF ground 120, and the center conductor 134 of the coaxial feed cable is soldered directly to the primary radiator 100. The outer jacket 132 can be soldered to the RF ground structure 120 (e.g., at the bottom surface of the RF ground structure 120) and terminate at the top surface 122 of the ground structure 120. The center conductor 134 extends beyond the top surface 122 of the ground structure 120 and into the distal end 114 of the sleeve 110 where it couples with the distal end 104 of the radiator 100.

In an example embodiment, the distal end 104 of the primary radiator 100 may include a substantially centrally located slight recession or hole and the center conductor 134 of the coaxial feed cable 130 can be inserted and subsequently soldered to the recession to provide a reliable connection between the radiator 100 and the cable conductor 134. Other suitable configurations can also be provided to provide a reliable connection between the radiator 100 and the cable conductor 134. For example, the primary radiator 100 may include additional structure such as a tab whereby the center conductor 134 of the coaxial feed cable 130 may be attached. The inclusion of additional structure on the primary radiator 100 may result in an offset of the coaxial feed cable 130 and, correspondingly, the hole in RF ground 120. This may further necessitate modification of the dielectric loading material in order to allow clearances for the additional structure on the primary radiator 100.

The space 103 between the sleeve 110 and primary radiator 100 will likely possess an effective dielectric constant for design and analysis purposes. To achieve enhanced tuning with this antenna, a variable dielectric constant is provided in the sleeve of the antenna. The sleeve 110 can be completely filled with a material whose dielectric constant varies in the Z-direction. Alternatively, a variable effective dielectric constant can be achieved by utilizing very common, cheap dielectric materials. The effective dielectric constant is achieved by loading the sleeve with materials that, in some cases, only partly fill the gap 103 between the sleeve 110 and the primary radiator 100. Therefore, we can essentially achieve any dielectric constant in a low-cost approach.

Figure 1B:
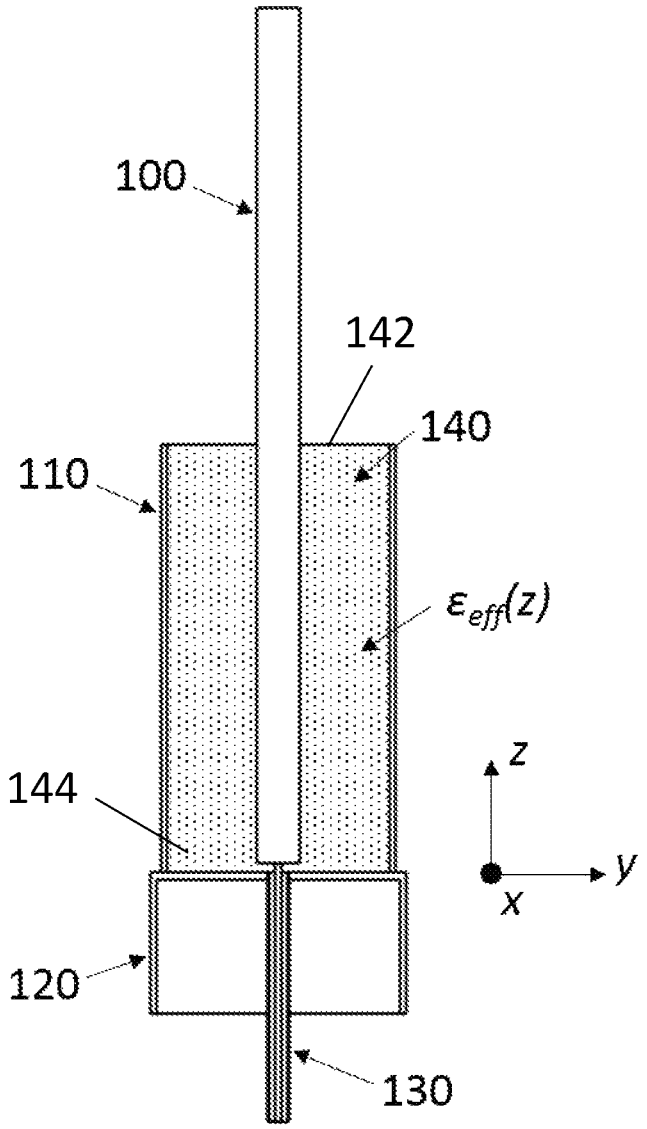

The space 103 may be entirely filled with a dielectric loading 140, including in the gap 101 between the radiator 100 and the ground structure 130. The dielectric loading 140 is designed to give an effective dielectric constant that varies with distance from the RF ground 120. In other words, the effective dielectric constant exhibits a Z-dependence as indicated in FIG. 1B where $\varepsilon_{eff}$ is written to exhibit some functional dependence on the variable Z with respect to the coordinate system shown in FIG. 1B; wherein for the $\varepsilon_{eff}(z)$ the (z) indicates that $\varepsilon_{eff}$ is some function of z. The effective dielectric constant at the distal end 104 of the primary radiator 100 where the sleeve 110 attaches to RF ground 120 is different than the effective dielectric constant at the opposite proximal end 104 of the radiator 100 and the distal end 114 of the sleeve 110. The change can vary gradually from one end to the other or it could be stepped (FIGS. 3, 4, and 6). The most important thing is that there is some change from one end to the other. A gradual change works best for most applications, but a stepped change might be more economical and easier to make (e.g., dielectric pucks with varying outer radii (FIG. 4) fabricated over some solid chunk of dielectric with some exotic contour to achieve the desired effective dielectric constant within the sleeve).

The gap 101 serves as a parameter to adjust the electrical performance (impedance match) of the antenna. In addition, the gap 101 ensures that the primary radiator 100 is not inadvertently shorted to the RF ground structure 120, which would render the antenna inoperable. In one embodiment, the gap 101 can be about 0.06 inches, but any suitable gap can be provided (greater or smaller than 0.06 inches) based on the dimensions of the primary radiator 100, the sleeve 110, and the loading material 140.

As those skilled in the art can appreciate, the permittivity for a given material is represented as $$\varepsilon=\varepsilon_0\varepsilon_r$$

where $\varepsilon_0$ is the permittivity in a vacuum (8.854*10-12 F/m), and $\varepsilon_r$ is the relative permittivity, or dielectric constant, for the material. The dielectric constant can be thought of as a scaling factor to represent the material permittivity relative to that of free space. The dielectric constant generally has some frequency dependence, but it remains fairly constant for typical dielectric materials at lower RF frequencies and frequencies used for mobile communications. As a result, the frequency dependence is neglected here.

Further note that the permittivity is generally complex where the imaginary part describes the loss associated with the material. The complex permittivity is written as $$\varepsilon=\varepsilon'-j\varepsilon''$$

where ε' and ε" are the real and imaginary parts of the permittivity respectively. The dielectric loss tangent for a material is defined as $$\tan\delta = \frac{\varepsilon''}{\varepsilon'}$$

and describes the amount of loss associated with the material. Materials exhibiting a low tan δ exhibit little energy lost due to the material.

The effective dielectric constant ($\varepsilon_{eff}$) generally refers to the dielectric constant observed by electromagnetic waves travelling through an inhomogeneous transmission medium where the fields are exposed to two or more materials with different dielectric constants. The effective dielectric constant consolidates the effects of multiple materials into a single dielectric constant for the given transmission medium. The use of the effective dielectric constant opens a new degree of freedom in tuning this antenna so that better return loss can be achieved over wider frequency bands given the limitations and operating conditions of the antenna for the present invention (space/volume limitations and mounting close to concrete or other structures with reference to the antenna of the '801 application). This facilitates impedance matching when the antenna electrically couples to objects in its environment which can modify the input impedance to the antenna.

Some examples of transmission media that are characterized by an $\varepsilon_{eff}$ are microstrip, stripline with dissimilar materials, and partially filled coaxial cable where the space between the inner and outer conductors is filled by a combination of multiple dielectric materials. In the present invention, the field structure in the sleeve portion of the antenna is found to be very similar to coaxial cable; therefore, it makes sense to characterize the effective dielectric constant in the sleeve portion of the antenna in a similar manner.

Figure 2A:
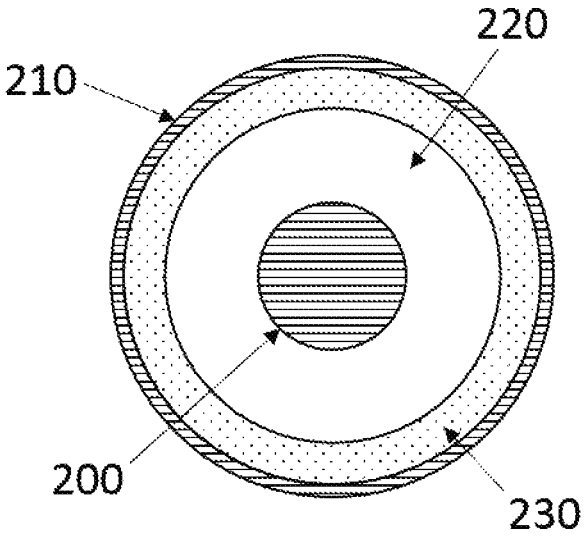
FIGS. 2A-2B illustrate the coaxial transmission line partially filled with dissimilar dielectric materials.
Figure 2B:
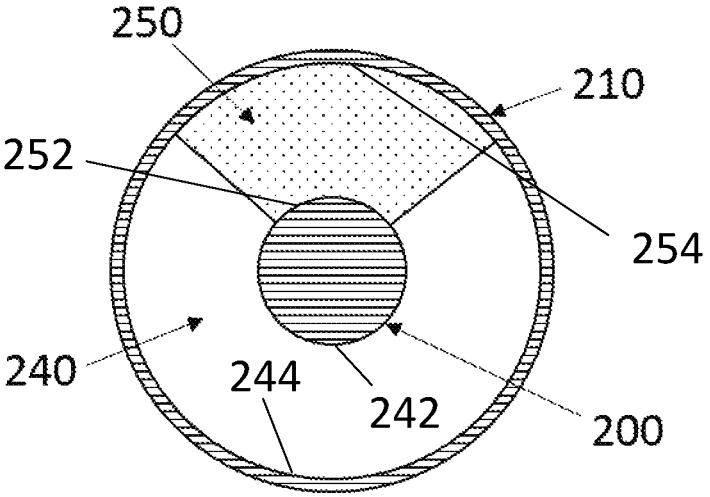

The partially loaded coaxial cable configuration for the antenna 5 is illustrated in FIG. 2 where one loading example configuration (series configuration) is shown in FIG. 2A and a different example loading configuration (parallel configuration) is shown in FIG. 2B. Referring to FIG. 2A, the coaxial cable has an inner conductor 200, an outer jacket 210, a first dielectric material layer 220, and a second dielectric material layer 230. Both the center conductor 200 and outer jacket 210 are composed of materials with high electrical conductivity such as copper. The first and second dielectric material layers 220, 230 are each composed of a material having a different dielectric constant. The first dielectric material 220 and second dielectric material 230 fill the space between the center conductor 200 and outer jacket 210. As shown in FIG. 2A, the two dielectric materials 220, 230 are arranged such that the first dielectric material 220 with $\varepsilon_{r1}$ and tan $\delta_1$ completely surrounds the center conductor 200 of the cable. And the second dielectric material 230 with $\varepsilon_{r2}$ and tan $\delta_2$ completely fills the space between the first dielectric material 220 and the outer jacket 230 of the cable.

Thus, the cable has a central conductor 200, a first dielectric material layer 220 surrounding the central conductor 200, a second dielectric material layer 230 surrounding the first dielectric material layer 230, and an outer jacket 210 surrounding the second dielectric material layer 230. The first dielectric layer 220 has a different dielectric material than the second dielectric layer 230 and can also have different thicknesses. In one example embodiment, the central core 200, first and second dielectric layers 220, 230, and outer jacket 210 each have a circular cross-section and are concentrically arranged with respect to each other.

In this configuration, the capacitances associated with the two dielectric layers 220, 230 are in series since all vectors describing the electric field pass through the first dielectric material layer 220 and then the second dielectric material layer 230. Hence, the cable has an effective dielectric constant can be calculated as $$\varepsilon_{eff} = \frac{\varepsilon_{r1}\varepsilon_{r2}\ln\left(\frac{r_b}{r_a}\right)}{\varepsilon_{r1}\ln\left(\frac{r_b}{r_1}\right) + \varepsilon_{r2}\ln\left(\frac{r_1}{r_a}\right)}$$

where $r_a$ is the radius of the center conductor 200, $r_b$ is the distance from the center of the cable to the inner contour of the outer jacket 210, and $r_1$ is the distance from the center of the cable to the outer contour of first dielectric material 220.

With respect to FIG. 2B, the first and second dielectric materials 240, 250 are arranged in a parallel configuration. Here, the first dielectric material 240 completely fills a first portion of the space between the center conductor 200 and the outer jacket 210. That is, the first dielectric material layer 240 extends the entire distance from the center conductor 200 to the outer jacket 210. But the first dielectric material layer 240 only partially extends around the central conductor 200 and outer jacket 210. The first dielectric material layer 240 has an inner surface 242 that conforms to the outer surface of the center conductor 200, and an outer surface 244 that conforms to the inner surface of the outer jacket 210. In the embodiment shown, the first dielectric material layer 240 surrounds approximately seventy-five percent (75%) of the inner conductor 200 and extends approximately seventy-five percent (75%) around the inside of the outer jacket 210.

The second dielectric material layer 250 completely fills the remaining portion of the space between the center conductor 200 and the outer jacket 210. The second dielectric material layer 250 has an inner surface 252 that conforms to the outer surface of the center conductor 200, and an outer surface 254 that conforms to the inner surface of the outer jacket 210. In the embodiment shown, the second dielectric material layer 250 surrounds approximately twenty-five percent (25%) of the inner conductor 200 and extends approximately twenty-five percent (25%) around the inside of the outer jacket 210.

In this case, the capacitances associated with the two dielectric layers 240, 250 are said to be in parallel since a vector describing the electric field can occupy either the first dielectric layer 240 or the second dielectric layer 250 depending on where the electric field vector is taken within the transmission line. Thus, an effective dielectric constant can be calculated as $$\varepsilon_{eff}=\alpha\varepsilon_{r1}+(1-\alpha)\varepsilon_{r2}$$

where $\alpha$ is the percent at which the first dielectric material 240 fills the space between the center conductor 200 and the outer jacket 210. For example, if the first dielectric material 240 fills 35% of the space between the center conductor 200 and the outer jacket 210, then $\alpha$ is 0.35. in one embodiment, values range from $\alpha=0$ to $\alpha=1$, though any value can be utilized depending on where you are in the sleeve of the antenna.

Figure 3A:
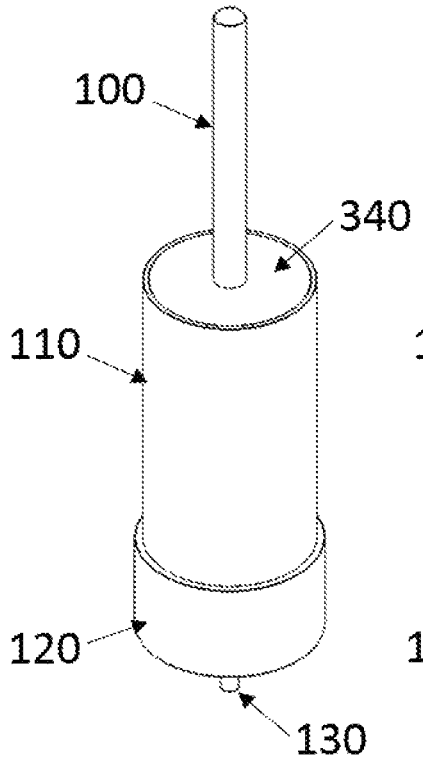
FIGS. 3A-3B illustrate the sleeve monopole with spatially variable dielectric loading using a layered approach.
Figure 3B:
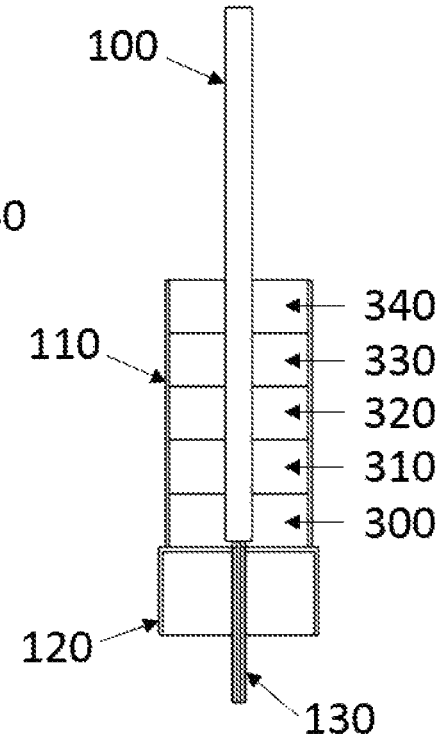

With respect to FIGS. 3A-3B, one example by which to realize spatial variability in the effective dielectric constant within the sleeve 110 is illustrated. Referring momentarily to FIG. 1B, the dielectric material 140 can be a single homogeneous layer of material having a proximal end 142 and a distal end 144. Or as shown in FIGS. 3A-3B, the dielectric material can be formed by multiple layers, for example five layers 300-340. Thus, the area between the sleeve 110 and the primary radiator 100 is completely filled with multiple dielectric material layers 300-340 stacked in a manner that achieves a variable dielectric constant. Since the space between the sleeve 110 and the primary radiator 100 is completely filled, the effective dielectric constant for each layer 300-340 is simply equal to the dielectric constant of the material used for each layer 300-340.

As illustrated, five layers 300-340 are shown, each having a different dielectric constant, namely: a first layer 300 exhibits $\varepsilon_{r1}$ and tan $\delta_1$, a second layer 310 exhibits $\varepsilon_{r2}$ and tan $\delta_2$, a third layer 320 exhibits $\varepsilon_{r3}$ and tan $\delta_3$, a fourth layer 330 exhibits $\varepsilon_{r4}$ and tan $\delta_4$, and a fifth layer 340 exhibits $\varepsilon_{r5}$ and tan $\delta_5$. The various layers 300-340 extend from the proximal end 112 of the sleeve 110 to the distal end 114 of the sleeve 110, with the first layer 300 being at and flush with the distal end 114 of the sleeve 110 and the fifth layer 340 being at and flush with the proximal end 112 of the sleeve 110, as shown.

There may be more or fewer than five layers; however, there should be at least two layers to realize spatial variation in the effective dielectric constant between the sleeve 110 and the primary radiator 100. Two or more layers may be composed of the same material exhibiting the same dielectric constant. For example, the first layer 300 and the second layer 310 may be high-density polyethylene (HDPE) so the effective dielectric constant is $\varepsilon_{eff}\approx 2.3$ from the bottom side of the first layer 300 through the top side of the second layer 310. However, all layers of this particular embodiment should not be composed of the same material as there would be no spatial variability in the effective dielectric constant within the sleeve. Furthermore, the individual layers 300-340 may be of different thicknesses or they may be the same thickness. The total dielectric loading material(s) may extend the full length of the sleeve 110, or it may only encompass a portion of the total height of the sleeve 110.

In one example embodiment, the largest value of dielectric constant is at the bottom of the sleeve 110, and the smallest value of dielectric constant is at the top of the sleeve 110. This is to get the best impedance match over frequency so that the input impedance is transformed to match the capacitive loading at the end of the sleeve portion. The layers are preformed before fitting down into the sleeve. In a sequence of assembly steps: (1) The sleeve and ground are attached (soldered). (2) The bottom layer is placed inside the sleeve to serve as the spacer between the primary radiator 100 and the RF ground 120. (3) The center conductor of the coaxial cable 130 is attached to the primary radiator 100 (soldered). (4) The outer jacket 132 of the coaxial cable 130 is soldered to the RF ground structure 120. (5) The remaining dielectric materials are fit over the primary radiator 100, and into the sleeve 110.

The layers may be bonded to one another, the sleeve 110, and/or the primary radiator 100. Ideally, the layers (other than the bottom layer) are bonded to each other and then fit down into the sleeve 110 over the primary radiator 100 where they are bonded to the top of the bottom layer. The bottom layer may be bonded to RF ground. If the layers are not bonded, there should be some mechanical support structure that attaches to the sleeve and/or the primary radiator that fixes the layers in place. If such a mechanical support structure is used, it should be non-metallic and possess a low dielectric constant (<3).

Turning to FIGS. 4A-4D, alternative examples for the realization of spatially variable effective dielectric constant within the sleeve 110 are presented. The approaches illustrated in FIGS. 4A-4D are similar to that shown in FIG. 3; however, the layers of FIGS. 4A-4D may or may not all have the same dielectric constant value. If all layers have the same dielectric constant, then the dielectric material between the sleeve 110 and the primary radiator 100 may be machined from a single dielectric material. Since there is additional machining to control the shape of the dielectric(s), spatial variation can be achieved. As in FIG. 3, the total dielectric loading material(s) may extend the full length and width of the sleeve 110, or it may only encompass a portion of the total length of the sleeve 110.

Figure 4A:
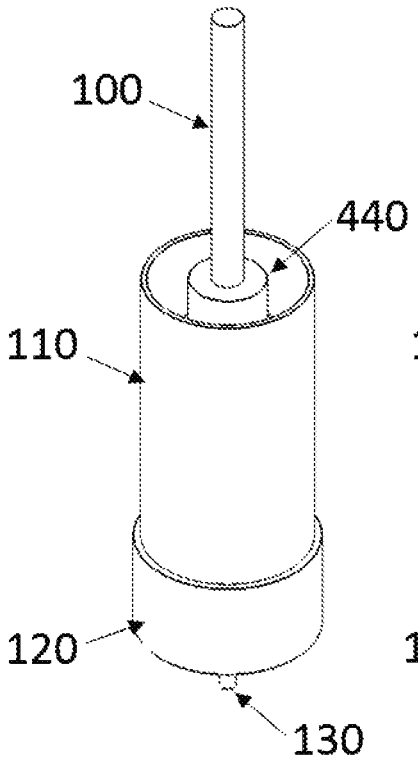
FIGS. 4A-4D illustrate two concepts to achieve spatial variability in the dielectric loading by machining dielectric materials.
Figure 4B:
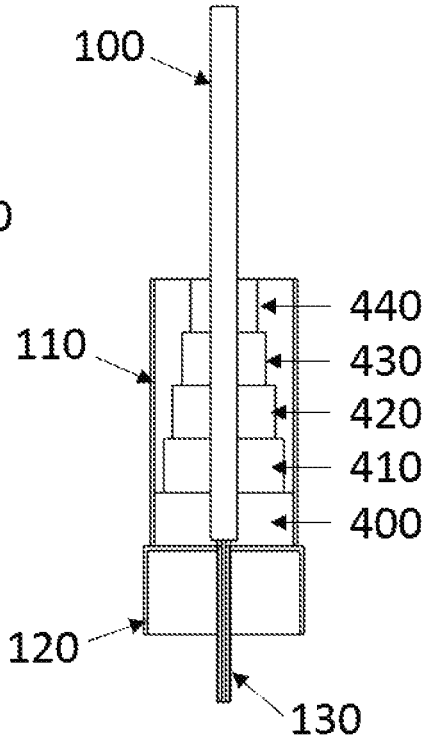

In one particular embodiment as shown in FIGS. 4A, 4B, the space between the sleeve 110 and the primary radiator 100 is filled with five layers of dielectric materials where the first layer 400 exhibits $\varepsilon_{r1}$ and tan $\delta_1$, the second layer 410 exhibits $\varepsilon_{r2}$ and tan $\delta_2$, the third layer 420 exhibits $\varepsilon_{r3}$ and tan $\delta_3$, the fourth layer 430 exhibits $\varepsilon_{r4}$ and tan $\delta_4$, and the fifth layer 440 exhibits $\varepsilon_{r5}$ and tan $\delta_5$. There may be more or fewer than five layers. Each layer 400-440 is machined with an inner contour or surface and an outer contour or surface where the inner contour of each layer 400-440 conforms to the outer contour or surface of the primary radiator 100 and the outer contour of each layer is allowed to vary. The outer contour of each layer 400-440 is constant for the full height of the layer so that the effective dielectric constant between the sleeve 110 and the primary radiator 100 varies in a stepped manner. That is, each layer is of uniform dimensions (i.e. the outer radius (or inner radius) of each individual layer does not vary with distance from RF ground). Thus, each layer is circular with a center opening, but each have a different diameters. Air fills the remaining space around the layers.

Furthermore, one or all layers 400-440 may exhibit the same dielectric constant. If two or more neighboring layers 400-440 exhibit the same dielectric constant, the multitude of layers may be machined from a single homogenous dielectric material. If all layers 400-440 are machined to have the same geometry, the dielectric constants of at least two of the layers 400-440 should differ in order to achieve spatial variation in the effective dielectric constant. In an alternative embodiment, the layers 400-440 may be machined in such a way that the outer contour of each layer is not constant. For example, each layer could be machined where the outer contour exhibits a maximum radius and a minimum radius so that the effective dielectric constant varies within each layer. The dielectric material used should exhibit a dielectric constant between $\varepsilon_r\approx 2\text{-}6$ with a loss tangent tan $\delta\leq 0.01$. The effective dielectric constant for the approach in FIGS. 4A, 4B may be calculated as a series combination of the loading material(s) and air.

In all scenarios, the layers (or any dielectric filler materials) are preformed and then fit down in the sleeve. This would follow the same assembly sequence outlined above with respect to FIGS. 3A-B. The layers may be adhered to the primary radiator 100 using a bonding agent that has a sufficient working time to allow assembly of the antenna. Otherwise, the layers may be bonded to one another, and fixed in place using a mechanical support that attaches to the sleeve 110 and/or the primary radiator 100. This support should be non-metallic and made of plastic material that has a relatively low dielectric constant (preferably <3). Alternatively, the bottom layer can be bonded to the RF ground 120, and the remaining layers can be subsequently bonded together. The thickness need not be rigidly defined, but the effective dielectric constant should generally decrease from the bottom of the sleeve to the top of the sleeve. This generally results in the layers getting thinner as they approach the top of the sleeve, but the thickness is determined by the material chosen for each layer and the desired effective dielectric constant. If all of the layers 400-440 are composed of the same material, the full collection of layers may be machined from a single piece of homogeneous material.

Figure 4C:
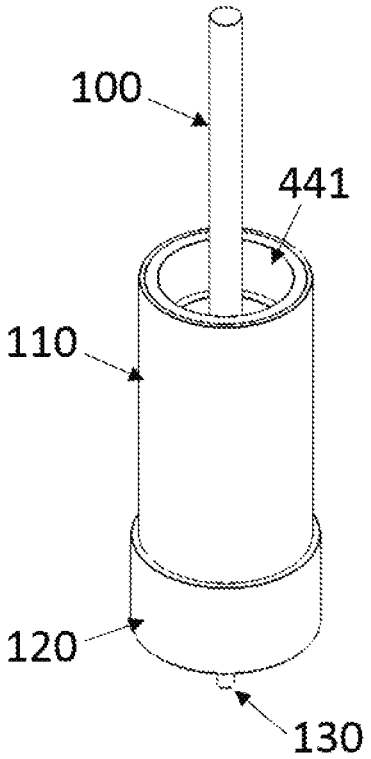
Figure 4D:
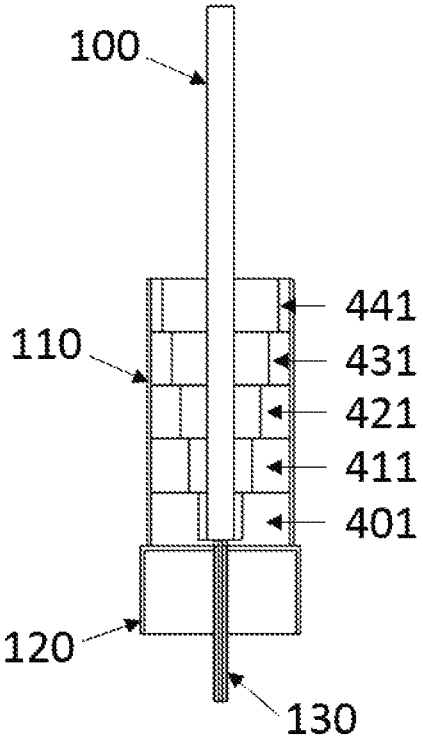

In another embodiment as shown in FIGS. 4C-4D, the space between the sleeve 110 and the primary radiator 100 is filled with five layers of dielectric materials where the first layer 401 exhibits $\varepsilon_{r1}$ and tan $\delta_1$, the second layer 411 exhibits $\varepsilon_{r2}$ and tan $\delta_2$, the third layer 421 exhibits $\varepsilon_{r3}$ and tan $\delta_3$, the fourth layer 431 exhibits $\varepsilon_{r4}$ and tan $\delta_4$, and the fifth layer 441 exhibits $\varepsilon_{r5}$ and tan $\delta_5$. There may be more or fewer than five layers. Each layer is machined with an inner contour and an outer contour where the outer contour of each layer conforms to the inner contour of the sleeve 110 and the inner contour of each layer is allowed to vary. The inner contour of each layer is constant for the full height of the layer so that the effective dielectric constant between the sleeve 110 and the primary radiator 100 varies in a stepped manner.

Furthermore, one or all layers 401, 411, 421, 431, 441 may exhibit the same dielectric constant. If two or more neighboring layers exhibit the same dielectric constant, the multitude of layers may be machined from a single homogenous dielectric material. If all layers are machined to have the same geometry, the dielectric constants of at least two layers should differ in order to achieve spatial variation in the effective dielectric constant. In an alternative embodiment, the layers may be machined in such a way that the outer contour of each layer is not constant. For example, each layer could be machined where the inner contour exhibits a maximum radius and a minimum radius so that the effective dielectric constant varies within each layer. The dielectric material used should exhibit a dielectric constant between $\varepsilon_r \approx 2\text{-}6$ with a loss tangent $\tan\delta \leq 0.01$. The effective dielectric constant for the approach in FIGS. 4C-4D may be calculated as a series combination of the loading material(s) and air. The layers are shown with the smallest thickness at the top layer 441 and the largest thickness at the bottom layer 401. That arrangement is practical because it is easier to achieve an effective dielectric constant that decreases with distance from RF ground. However, the layers can be arranged in any suitable manner, such as the bottom layer 401 having the smallest thickness, or the layers having varying degrees of thickness, as long as spatial variation in the effective dielectric constant can be achieved.

The layers 401-441 may be adhered to the sleeve 110, or they may be adhered to one another and fixed in place mechanically with some attachment to the sleeve 110. This configuration would be advantageous over FIGS. 4A-4B if the primary radiator 100 possesses a small diameter, which could make it difficult to precisely drill each layer 400-440 and maintain alignment within the sleeve 110 in the embodiment of FIGS. 4A-4B. The advantage of the embodiment of FIGS. 4A-4B is that the layers 400-440 provide mechanical support to the primary radiator 100. Without this support (as in FIGS. 4C-4D), some structure could be provided to hold the central radiator 100 upright and in the center of the sleeve 110. For example, this structure could be a plastic piece that sits at the distal end of the sleeve 110 attached to the sleeve 110 and the primary radiator 100 that fixes the primary radiator 100 in a position relative to the sleeve 110.

The layers 401-441 may be adhered to the sleeve 110 using a bonding agent that has a sufficient working time to allow assembly of the antenna. Otherwise, the layers may be bonded to one another, and fixed in place using a mechanical support that attaches to the sleeve 110 and/or primary radiator 100. This support should be non-metallic and made of some plastic material that has a relatively low dielectric constant (preferably <3). Alternatively, the bottom layer can be bonded to RF ground, and the remaining layers can be subsequently bonded together. Also, if all of the layers 401-441 are composed of the same material, the full collection of layers may be machined from a single piece of homogeneous material. In addition, while the layers of FIGS. 3-4 are shown directly adjacent to and touching one another, two or more of the layers can be spaced apart from one another.

Figure 5A:
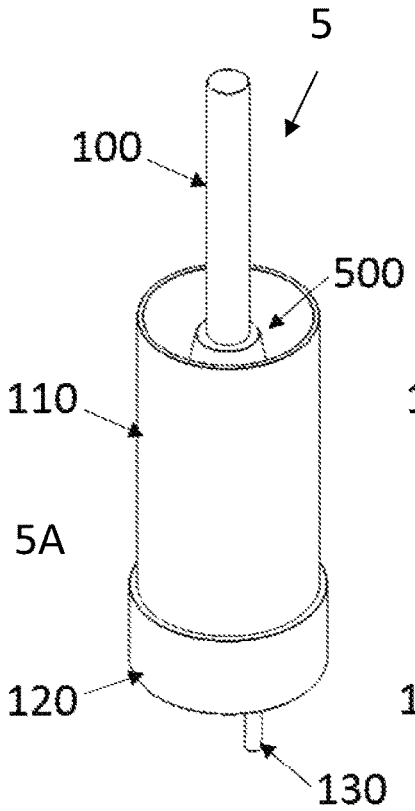
FIGS. 5A-5C illustrate an embodiment of the dielectric loaded sleeve monopole antenna.
Figure 5B:
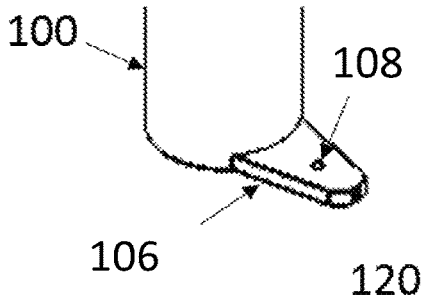
Figure 5C:
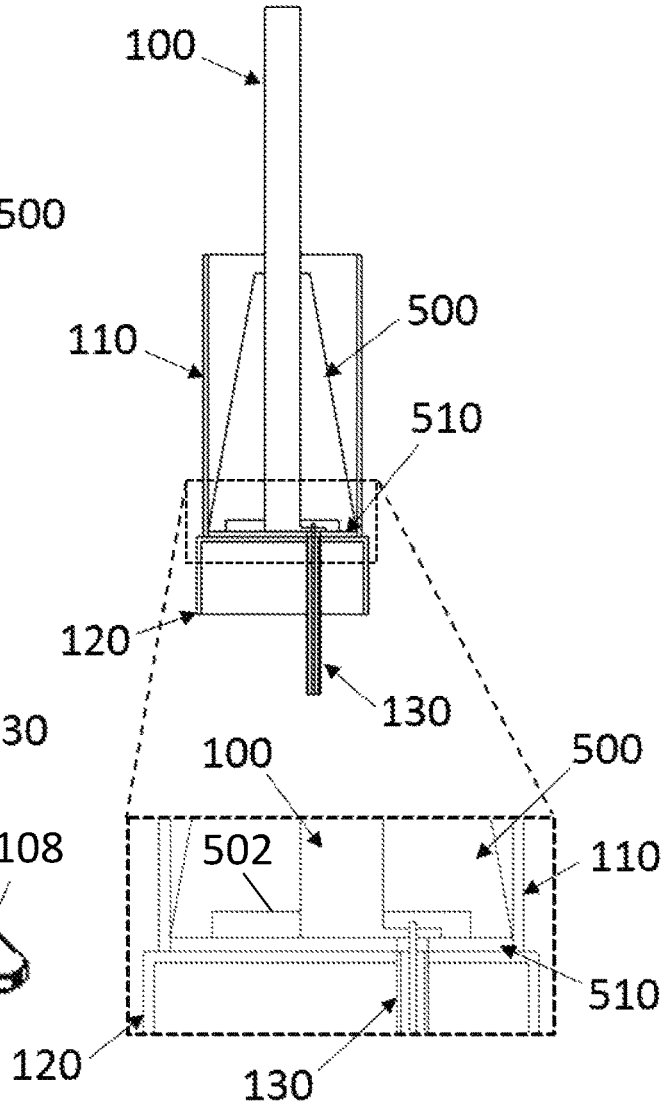

Another example embodiment of the antenna 5 is illustrated in FIGS. 5A, 5B, 5C and is a variation of the approach outlined in FIG. 4A. The sleeve 110 is approximately 3.1 inches in length, or approximately $\lambda/4$ at the highest operating frequency (960 MHz) where $\lambda$ is the free-space wavelength. The primary radiator 100 extends approximately 3.3 inches past the end of the sleeve 110, and RF ground extends slightly less than 1" from the base of the sleeve 110. As indicated in FIG. 1A, there is a spacing 101 between the top of the RF ground 120 and the distal end 104 of the primary radiator 100. In one example embodiment, this spacing 101 is set to 0.06" but can be adjusted for impedance matching. Approximate minimum and maximum dimensions are as follows. The sleeve 110 can be approximately 2.9"-3.1", the monopole extension past the end of the sleeve 110 can be 2.9"-3.6", and the space 101 can be 0.054"-0.066". Note that these dimensions may be able to vary further if measures are taken to tune the antenna 5 for the specific dimensions. These minimum and maximum dimensions basically capture tolerance analysis whereby the antenna should still perform as intended without a redesign of the antenna.

In order to maintain this spacing 101 and improve manufacturability, the dielectric loading material is split into an upper member or piece 500 and a lower member or piece 510. In the preferred embodiment, the upper piece 500 and lower piece 510 of the dielectric loading material are both made of machined polytetrafluoroethylene (PTFE), or Teflon with $\varepsilon_r \approx 2.1$ and $\tan\delta \approx 0.001$. The spatial variability is realized in a manner similar to the approach outlined in FIG. 4A where the upper piece 500 has an outer contour of the Teflon that varies linearly in a conical fashion from the base of the sleeve 110 to the top of the Teflon loading material. The total height of the Teflon material is approximately 2.9". In one embodiment, the upper piece 500 does not extend the full length of the sleeve 110, to provide the best impedance match with the Teflon. The widest end of the upper piece 500 can be positioned at the proximal end 114 of the sleeve 110. This provides the best impedance matching for the antenna 5 by transforming the input impedance to match the capacitive loading at the end of the sleeve 110.

As further indicated in FIGS. 5B, 5C, the primary radiator 100 includes a tab 106 extending from the base parallel to the top of RF ground 120. This tab 106 includes a hole 108 through which the center conductor 134 of the coaxial feed cable 130 is passed and soldered to make electrical contact. The tab 106 can extend outward from the side of the radiator 100 at the distal end of the radiator 100 and can be flat. The cable 130 is offset within the ground member 120 to align the center conductor 134 with the hole 108 in the tab 106.

In order to accommodate the tab 106 and solder attachment for the coaxial center conductor 134, the distal end of the dielectric loading material upper piece 500 is machined with a void 502 as shown in FIG. 5. The radius of the void 502 should be large enough to accommodate the tab 106 on the primary radiator 100, but not as large as the inner radius of the sleeve 110. The height of the void 502 should only be large enough to accommodate the height of the tab 106 and the center of the coaxial feed cable 130 extending through the tab 101 with some clearance (tens of mils is desired). In an example embodiment, the height of the void 502 is approximately 0.125".

As a result of the void 502, an air gap exists between the dielectric loading material lower piece 510 and a portion of the dielectric loading material upper piece 500. This air gap reduces the effective dielectric constant in the region of the solder attachment between the center conductor of the coaxial feed cable 130 and the tab 101 on the main radiator 100 but is necessary for manufacturability. The dielectric loading material upper piece 500 and lower piece 510 may be bonded together using a non-conductive epoxy.

Figure 6A:
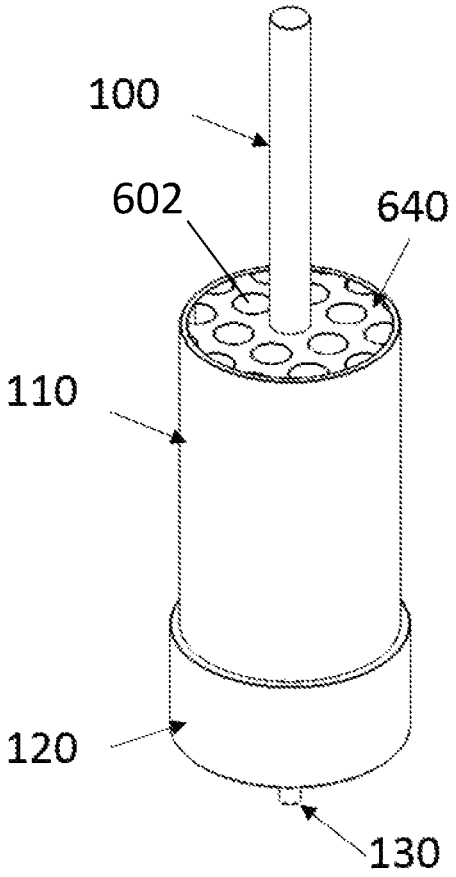
FIGS. 6A-6B illustrate a concept to achieve spatial variability in the dielectric loading by drilling holes into dielectric materials.
Figure 6B:
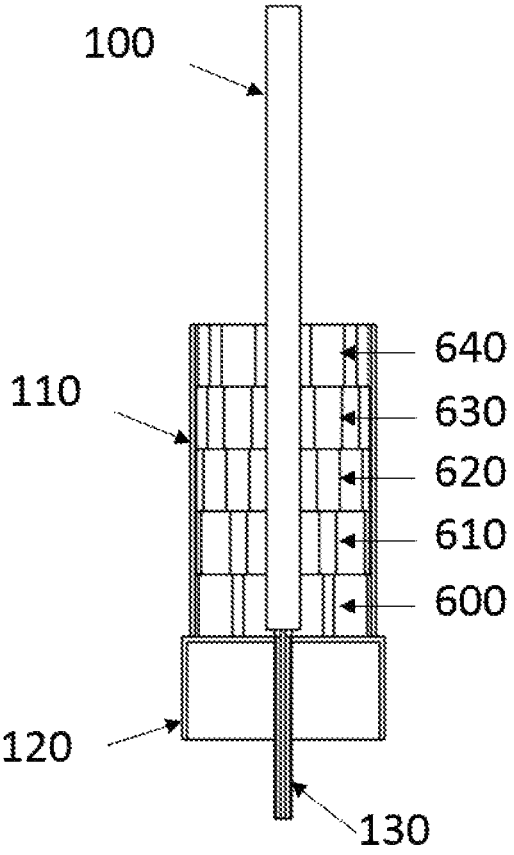

In yet another embodiment, the layers of dielectric material may be drilled to achieve an effective dielectric constant as indicated in FIGS. 6A, 6B. Similar to FIG. 3, the antenna is shown with five layers of dielectric materials where the first layer 600 exhibits $\varepsilon_{r1}$ and $\tan\delta_1$, the second layer 610 exhibits $\varepsilon_{r2}$ and $\tan\delta_2$, the third layer 620 exhibits $\varepsilon_{r3}$ and $\tan\delta_3$, the fourth layer 630 exhibits $\varepsilon_{r4}$ and $\tan\delta_4$, and the fifth layer 640 exhibits $\varepsilon_{r5}$ and $\tan\delta_5$. There may be more or fewer than five layers. Each layer is drilled with one or more holes 602 of a particular diameter where all the holes 602 in a given layer are the same diameter so that the dielectric constant is uniform for each layer. Of course, the holes 602 can have different diameters to achieve an effect similar to FIGS. 4, 5, which provides more freedom in synthesizing a desired effective dielectric constant in each layer. The holes in different layers may be the same diameter, or they may be different diameters depending on the material and the desired dielectric constant for each layer. In general, the holes 602 extend completely through the entire layer 600-604, and are drilled with their axes aligned parallel to the longitudinal axis of the primary radiator 100.

The holes achieve an effective dielectric constant. By removing some of the material, the effective dielectric constant seen by the antenna is reduced compared to if there were no holes. This is another means of achieving an effective dielectric constant as opposed to FIGS. 3 and 4. This approach would be suited for an additive manufacturing approach (3D printing) where the fill factor can be precisely controlled and each layer is not a completely solid piece of material. An additive manufacturing approach might be preferred here to drilling the materials. Depending on the materials and the hole diameters/spacing, it could be difficult to accurately drill the holes as desired. The holes offer more of a range for dielectric constant than the approach of FIG. 3. The embodiment of FIG. 3 is limited to the dielectric constant of the material that is being utilized. However, by drilling holes into a puck of dielectric material, a lower dielectric constant can be achieved that might offer better performance for the antenna. For example, for a puck of material with a dielectric constant of 3, drilling holes could provide a dielectric constant of about 2.75.

In an example embodiment, all of the layers 600-640 may have the same dielectric constant, and the dielectric loading may be machined from a single homogenous dielectric material where the holes 602 are subsequently drilled to synthesize the desired effective dielectric constant. Similar to the approaches outlined in FIGS. 3 and 4, the total dielectric loading material(s) may extend the full length of the sleeve, or it may only encompass a portion of the total height of the sleeve 110. The effective dielectric constant for each layer 600-640 of the configuration illustrated in FIG. 6 may be calculated as a parallel combination of air and the dielectric material in which the holes are drilled. A volumetric fill factor should be used to compute the effective dielectric constant for each layer. The dielectric material used should exhibit a dielectric constant between $\varepsilon_r \approx 2\text{-}6$ with a loss tangent $\tan\delta \leq 0.01$.

Note that the aforementioned methods by which to realize a spatially variable dielectric constant within the sleeve portion of the antenna are subtractive manufacturing examples. That is, material is cut away, or otherwise removed, from a larger solid piece of material to achieve the end result. However, the variable dielectric constant may also be realized by additive manufacturing, such as 3D printing and 3D printed materials. For example, the approach of FIG. 6 is suited for 3D printing where solid chunks of material are not required, but the fill factor of a given layer can be precisely controlled to achieve a desired dielectric constant.

Figure 7A:
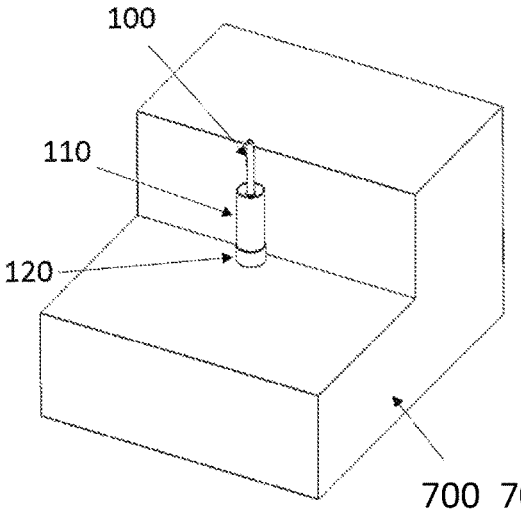
FIGS. 7A-7D illustrate a sample operating environment for the present invention and the antenna impedance with variations in the environment.

As an illustrative example of the antenna placement and performance, FIGS. 7A, B show the antenna 5 of the preferred embodiment operating in close proximity to a concrete structure 700. For example, the concrete structure 700 represents the steps of a stadium where this antenna 5 is a practical solution for mobile communications. The antenna 5 can be mounted, for example, to a railing located in close proximity to the concrete steps. The primary difficulty in the illustrated operating environment is that the loading effects of the concrete must be take into account in the antenna design. Since the concrete structure 700 lies within the nearfield of the antenna, the dielectric properties of the concrete play a role in the antenna input impedance. Furthermore, concrete is porous and can absorb water. As a result, the dielectric properties of the concrete may change considerably depending on the weather for outdoor environments. Research has shown that the dielectric constant of concrete can change from $\varepsilon_r \approx 4$ with $\tan\delta \approx 0.01$ for dry concrete to $\varepsilon_r \approx 15$ with $\tan\delta \approx 0.12$ for concrete saturated with water. The spatially variable dielectric loading within the sleeve of the antenna enables stable impedance with dramatic changes in the concrete dielectric properties.

Figure 7B:
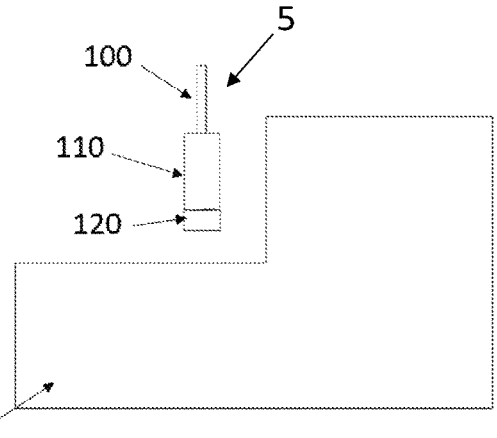
Figure 7C:
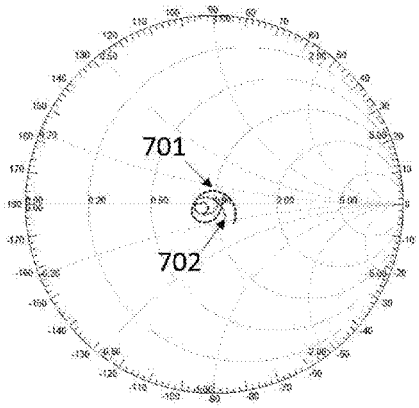
Figure 7D:
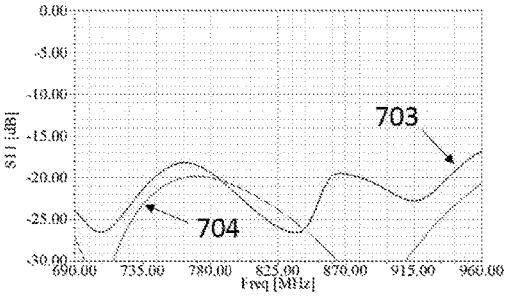

The predicted impedance and return loss for the antenna configuration in FIGS. 7A, 7B are shown in FIGS. 7C, 7D. In FIG. 7C, the input impedance for dry concrete 701 is compared against the input impedance for wet concrete 702 on the Smith chart. The further away the two curves are from the center of the Smith chart, the worse the impedance match is to the antenna. The center of the Smith Chart indicates a perfect impedance match. The two curves as shown indicate a very good impedance match for the antenna in the presence of the concrete over the operating band. Furthermore, the two curves overlay quite well for dry concrete and for wet concrete indicating stable input impedance with different levels of water absorption by the concrete.

It is further noted that the variable dielectric loading acts as an impedance transformer providing additional impedance matching capability between the feed point of the antenna (where the coaxial cable attaches to the primary radiator 100) and the end of the sleeve 110. The use of the variable dielectric loading (impedance transformer) enables the antenna to achieve a better impedance match over a broader bandwidth than the antenna without variable dielectric loading. For example, the antenna of the preferred embodiment with variable dielectric loading exhibits a −15 dB return loss bandwidth of approximately 56%. The best case antenna without variable dielectric loading is found to achieve a −15 dB return loss bandwidth of approximately 44%.

The variable dielectric constant provides enhanced tuning capability enabling the antenna to achieve a better impedance match over a broader band than the antenna with single-material dielectric loading or the antenna without any loading (only air between the sleeve and primary radiator). Even with drastic changes in the dielectric constant of the concrete, the impedance match to the antenna remains very good. This is partly due to the nature of the sleeve monopole. The sleeve shields the feed point of the antenna where the antenna impedance is most sensitive to changes. As a result, the antenna inherently possesses some immunity to changes in its environment. The variable dielectric loading provides enhanced tuning capability over the traditional sleeve monopole further enhancing the ability to achieve broadband impedance matching with a small ground plane in a dynamic environment.

In FIG. 7D, the return loss plot also indicates a stable impedance match where the return loss for dry concrete 703 is compared against the return loss for wet concrete 704. Both curves indicate return loss better than −15 dB and overlay reasonably well. With a −10 dB return loss, only 10% of the power delivered to the antenna is reflected back from the antenna meaning that 90% of the power is available to radiate from the antenna. With a −15 dB return loss, only approximately 3% of the power delivered to the antenna is reflected back from the antenna meaning that nearly 97% of the power is available to radiate from the antenna.

Within this specification embodiments have been described in a way which enables a clear and concise specification to be written, but it is intended and will be appreciated that embodiments may be variously combined or separated without departing from spirit and scope of the invention. It will be appreciated that all features described herein are applicable to all aspects of the invention described herein. Thus, for example, although the series and parallel cables are only shown and described with respect to FIG. 2B, that feature can be utilized in any of the embodiments of FIGS. 1, 3-7.

The description uses several geometric or relational terms, such as circular, rounded, stepped, parallel, concentric, and flat. In addition, the description uses several directional or positioning terms and the like, such as top, bottom, base, lower, distal, and proximal. Those terms are merely for convenience to facilitate the description based on the embodiments shown in the figures. Those terms are not intended to limit the invention. Thus, it should be recognized that the invention can be described in other ways without those geometric, relational, directional or positioning terms. In addition, the geometric or relational terms may not be exact. For instance, walls may not be exactly perpendicular or parallel to one another but still be considered to be substantially perpendicular or parallel because of, for example, roughness of surfaces, tolerances allowed in manufacturing, etc. And, other suitable geometries and relationships can be provided without departing from the spirit and scope of the invention.

Within this specification, the terms "substantially" and "about" mean plus or minus 20%, more preferably plus or minus 10%, even more preferably plus or minus 5%, most preferably plus or minus 2%.

The foregoing description and drawings should be considered as illustrative only of the principles of the invention. The invention may be configured in a variety of shapes and sizes and is not intended to be limited by the preferred embodiment. Numerous applications of the invention will readily occur to those skilled in the art. Therefore, it is not desired to limit the invention to the specific examples disclosed or the exact construction and operation shown and described. Rather, all suitable modifications and equivalents may be resorted to, falling within the scope of the invention.

The invention claimed is:

1. An antenna comprising: a radiating element extending substantially orthogonally from a ground structure; and an electrically conductive sleeve at least partially enclosing the radiating element, thereby forming a space between said at least partially enclosed radiating element and said sleeve; a dielectric material at least partially filling the space, wherein the dielectric material comprises a plurality of dielectric material layers: one or more holes in a plurality of dielectric material layers; wherein the one or more holes have an axis aligned parallel to a longitudinal axis of the radiating element: and wherein the diameters of the holes vary with distance from the ground structure.

2. The antenna of claim 1, further comprising a coaxial cable having an outer sleeve and a center conductor, said outer sleeve coupled to the ground structure.

3. The antenna of claim 2, wherein the center conductor of the coaxial cable is coupled to the radiating element.

4. The antenna of claim 1, wherein the dielectric material has an effective dielectric constant that exhibits spatial variation.

5. The antenna of any claim 1, wherein said sleeve has a longitudinal axis and the dielectric material has a dielectric constant that varies along the longitudinal axis of said sleeve.

6. The antenna of claim 1, wherein said dielectric material has a dielectric constant that varies with distance from the ground structure.

7. The antenna of claim 1, wherein said dielectric material has a first dielectric material portion with a first dielectric constant and a second dielectric material portion with a second dielectric constant different than the first dielectric constant.

8. The antenna of claim 7, wherein said first dielectric material portion comprises a first dielectric layer and said second dielectric material portion comprises a second dielectric layer.

9. The antenna of claim 1, wherein the dielectric material is a solid homogeneous dielectric material.

10. The antenna of claim 1, wherein the dielectric material has an outer contour and an inner contour, and wherein the outer contour of the dielectric material varies with distance from the ground structure, and the inner contour of the dielectric material conforms to an outer contour of the radiating element.

11. The antenna of claim 1, wherein the dielectric material has an outer contour and an inner contour, and wherein the inner contour of the dielectric material varies with distance from the ground structure, and the outer contour conforms to an inner contour of the conductive sleeve.

12. The antenna of claim 1, wherein the plurality of dielectric material layers are stacked in a manner that provides an effective dielectric constant that varies with distance from the ground structure.

13. The antenna of claim 1, wherein the plurality of dielectric material layers are individually machined to realize a desired effective dielectric constant.

14. The antenna of claim 1, wherein each of the plurality of dielectric material layers has an outer contour and an inner contour, and the outer contour of the plurality of dielectric material layers varies with distance from the ground structure, and the inner contours of the dielectric material layers conform to an outer contour of the radiating element.

15. The antenna of claim 1, wherein each of the plurality of dielectric material layers has an outer contour and an inner contour, and the inner contours of the plurality of dielectric material layers varies with distance from the ground structure, and the outer contours conform to an inner contour of the conductive sleeve.

16. The antenna of claim 1, herein the ground structure comprises a Radio Frequency (RF) ground structure.

* * * * *